US009429893B2

(12) United States Patent
Yamamoto

(10) Patent No.: US 9,429,893 B2
(45) Date of Patent: Aug. 30, 2016

(54) MOVABLE TRAY COVER CONFIGURATION FOR AN IMAGE FORMING APPARATUS

(71) Applicant: Koyo Yamamoto, Nissin (JP)

(72) Inventor: Koyo Yamamoto, Nissin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 78 days.

(21) Appl. No.: 13/753,680

(22) Filed: Jan. 30, 2013

(65) Prior Publication Data

US 2013/0195533 A1 Aug. 1, 2013

(30) Foreign Application Priority Data

Jan. 31, 2012 (JP) ..... 2012-017776

(51) Int. Cl.

*G03G 15/00* (2006.01)
*B41J 29/13* (2006.01)
*B65H 31/02* (2006.01)
(Continued)

(52) U.S. Cl.

CPC ..... *G03G 15/6552* (2013.01); *B41J 29/13* (2013.01); *B65H 29/125* (2013.01); *B65H 29/14* (2013.01); *B65H 31/02* (2013.01); *B65H 2301/512565* (2013.01); *B65H 2402/441* (2013.01); *B65H 2405/1117* (2013.01); *B65H 2405/1124* (2013.01); *B65H 2601/111* (2013.01); *B65H 2601/255* (2013.01); *B65H 2801/12* (2013.01)

(58) Field of Classification Search

CPC ..... G03G 15/6552; G03G 2221/16; G03G 2221/1678; G03G 2221/1687; G03G 2221/169; B65H 31/02
USPC ..... 399/110, 124, 125, 114, 405; 400/647.1, 691, 692, 693
See application file for complete search history.

(56) References Cited

U.S. PATENT DOCUMENTS 6,190,116 B1 2/2001 Asada
6,612,763 B1 9/2003 Yoshihara
(Continued)

FOREIGN PATENT DOCUMENTS

CN 101221385 A 7/2008
JP H01-213669 A 8/1989
(Continued)

OTHER PUBLICATIONS

European Search Report received in corresponding European Application No. 13153307.7, mailed Jul. 10, 2013.
(Continued)

*Primary Examiner* — Blake A Tankersley
*Assistant Examiner* — Quang X Nguyen
(74) *Attorney, Agent, or Firm* — Banner & Witcoff, Ltd.

(57) ABSTRACT

An image forming apparatus includes an ejection tray including a support portion, a plurality of ejection rollers having a nip portion, and a tray cover having a first surface and a second surface and being configured to move between an extended position where the first surface faces upward and a covering position where the tray cover is supported by the support portion to cover an upper surface of the ejection tray and the second surface faces upward. When the tray cover is in the covering position, an upstream end portion of the second surface of the tray cover in a sheet ejection direction is disposed in a position closer to the nip portion than the upper surface of the ejection tray and lower than the nip portion such that a leading end of the recording sheet ejected from the nip portion passes on or over the second surface.

12 Claims, 6 Drawing Sheets

(51) Int. Cl.
*B65H 29/12* (2006.01)
*B65H 29/14* (2006.01)

(56) References Cited

U.S. PATENT DOCUMENTS

| | | | | |
|---|---|---|---|---|
| 7,722,034 | B2 * | 5/2010 | Kosuda et al. | 271/223 |
| 8,208,834 | B2 | 6/2012 | Yamaguchi | |
| 8,219,080 | B2 | 7/2012 | Ito | |
| 2006/0088336 | A1 * | 4/2006 | Hirose et al. | 399/110 |
| 2008/0080915 | A1 | 4/2008 | Ito | |
| 2008/0166141 | A1 | 7/2008 | Watanabe et al. | |
| 2009/0140490 | A1 * | 6/2009 | Kozaki | 271/109 |
| 2009/0252528 | A1 * | 10/2009 | Yamaguchi | 399/111 |
| 2010/0315658 | A1 * | 12/2010 | Niikawa | G03G 21/1628 358/1.5 |
| 2011/0089626 | A1 * | 4/2011 | Betto | B65H 29/18 271/4.05 |

FOREIGN PATENT DOCUMENTS

| | | | |
|---|---|---|---|
| JP | H03-229275 | A | 10/1991 |
| JP | H05-19547 | A | 1/1993 |
| JP | H054769 | A | 1/1993 |
| JP | H1160024 | A | 3/1999 |
| JP | 2001-109311 | A | 4/2001 |
| JP | 2002-348024 | A | 12/2002 |
| JP | 2007-142497 | A | 6/2007 |
| JP | 2008-087869 | A | 4/2008 |
| JP | 4107321 | B2 | 6/2008 |
| JP | 2009-251231 | A | 10/2009 |

OTHER PUBLICATIONS

Dec. 25, 2014—(CN) Notification of the First Office Action—App 201310034740.2.

Nov. 17, 2015—(JP) Notice of Reasons for Rejection—App 2012-017776.

Feb. 15, 2016—(CN) Notification of the Third Office Action—App 201310034740.2.

Aug. 31, 2015—(CN) Notification of the Second Office Action—App 201310034740.2.

Jun. 7, 2016—(JP) Decision of Final Rejection—App 2012-017776.

* cited by examiner

MOVABLE TRAY COVER CONFIGURATION FOR AN IMAGE FORMING APPARATUS

CROSS REFERENCE TO RELATED APPLICATION

This application claims priority from Japanese Patent Application No. 2012-017776, filed on Jan. 31, 2012, which is incorporated herein by reference in its entirety.

FIELD

Aspects of the disclosure relate to an image forming apparatus including a tray cover configured to cover an ejection tray.

BACKGROUND

A known image forming apparatus includes an ejection tray and a tray cover that is rotatably attached to the ejection tray and pivotable between the covering position and the extended position. Specifically in this art, when the tray cover is in the covering position, an end portion of the tray cover is located above a sheet ejection port (which is an opening located substantially level with a nip portion of an ejection roller).

SUMMARY

However, in the this art, as the end portion of the tray cover is located above the nip portion of the ejection roller, if a user accidentally instructs a print command with the tray cover being in the covering position, a sheet ejected from the nip portion of the ejection roller may hit against a lower surface of the tray cover and get jammed.

Illustrative aspects of the disclosure provide an image forming apparatus configured to reduce jamming of recording sheets even with a tray cover being in a covering position.

According to an aspect of the disclosure, an image forming apparatus includes an ejection tray including a support portion, a plurality of ejection rollers having a nip portion where the plurality of ejection rollers nip a recording sheet therebetween and being configured to eject the recording sheet onto the ejection tray, and a tray cover having a first surface and a second surface opposite to the first surface. The tray cover is configured to move between an extended position where the tray cover is extended relative to an upper surface of the ejection tray and the first surface faces upward to receive the recording sheet ejected from the nip portion and a covering position where the tray cover is supported by the support portion of the ejection tray to cover the upper surface of the ejection tray and the second surface faces upward. When the tray cover is in the covering position, an upstream end portion of the second surface of the tray cover in a sheet ejection direction where the recording sheet is ejected is disposed in a position closer to the nip portion than the upper surface of the ejection tray and lower than the nip portion such that a leading end of the recording sheet ejected from the nip portion passes on or over the second surface.

With this structure, even when the tray cover is in the covering position, the leading end of the sheet ejected from the nip portion of the ejection rollers can pass on or over the second surface, facing upward, of the tray cover, and thus jamming of a recording sheet due to contact of the first surface, facing downward, of the tray cover can be reduced.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. In the following description, a general structure of a laser printer as an example of an image forming apparatus will be described and then features of the disclosure will be described in detail.

In the following description, orientations or sides of the laser printer will be identified based on the laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top and bottom direction may be referred to as a vertical direction.

Figure 1:
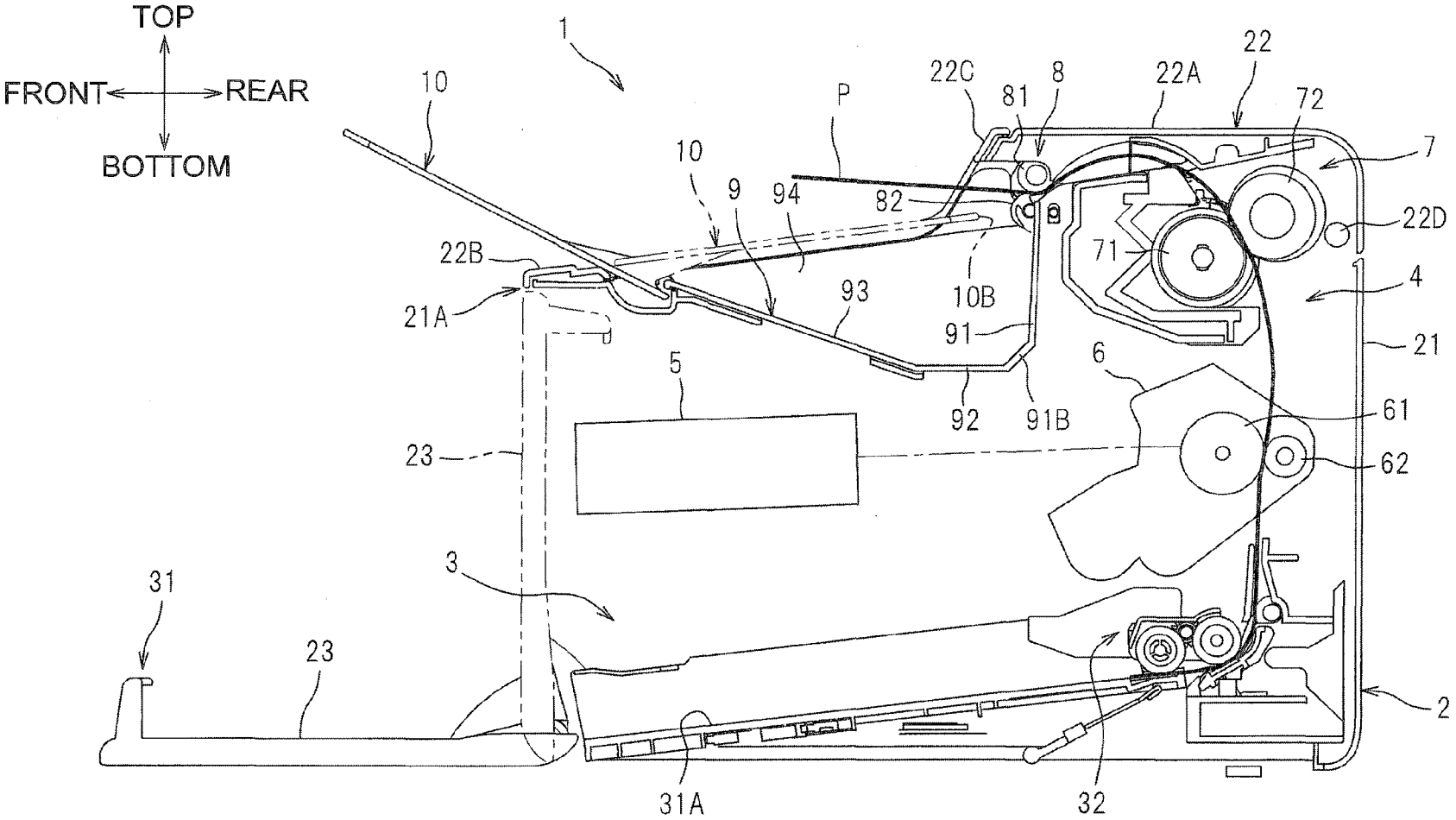
FIG. 1 illustrates a general structure of an illustrative image forming apparatus, e.g. a laser printer, according to an embodiment.

As shown in FIG. 1, the laser printer 1 includes a main body 2, a feeder portion 3 for feeding a sheet P as an example of a recording sheet, and an image forming portion 4 for forming an image on the sheet P.

The main body 2 includes a casing 21, a top cover 22 as an example of an upper wall, and a front cover 23. The casing 21 has, in an upper portion, an opening 21A through which a process cartridge 6 is attached and removed, and, in a front portion, an insertion opening 21B (FIG. 2) for inserting sheets P.

The opening 21A in the upper portion of the casing 21 is opened and closed by the top cover 22, while the insertion opening 21B in the front portion of the casing 21 is opened and closed by the front cover 23.

The feeder portion 3 includes a sheet tray 31 used for placing a sheet P thereon and a sheet feed mechanism 32 which feeds the sheet P on the sheet tray 31 toward the image forming portion 4.

The sheet tray 31 is made up of a tray portion 31A disposed in a lower portion of the main body 2 and the front cover 23. Specifically, the front cover 23 is pivotable about its lower end portion in the front-rear direction. The front cover 23 constitutes a part of the sheet tray 31 when tilted frontward.

In the feeder portion 3, the front cover 23 is tilted frontward to form the sheet tray 31 on which a sheet P is to be placed. The sheet P on the sheet tray 31 is to be fed to the image forming portion 4 by the sheet feed mechanism 32.

The image forming portion 4 includes a scanner unit 5, a process cartridge 6, and a fixing unit 7.

The scanner unit 5 is disposed in a front portion of the main body 2, and includes a laser emitting portion, a polygon mirror, a lens, and a reflecting mirror, which are not shown. The scanner unit 5 irradiates a surface of a photosensitive drum 61 with a laser beam at high speed scanning.

The process cartridge 6 is detachable through the opening 21A from the casing 21. The process cartridge 6 includes the photosensitive drum 61, a transfer roller 62 that transfers a toner image (a developer image) formed on the photosensitive drum 61 to a sheet P. The process cartridge 6 also includes a charger, a developing roller, a layer thickness regulating blade, and a toner chamber, which are known and not shown.

In the process cartridge 6, the surface of the photosensitive drum 61, which is rotating, is uniformly charged by the charger, and then exposed with the laser beam from the scanner unit 5 by high speed scanning Thus, a potential in an exposed area drops, and an electrostatic latent image based on image data is formed on the surface of the photosensitive drum 61.

The developing roller supplies toner in the toner chamber to the electrostatic latent image formed on the photosensitive drum 61, and a toner image is formed on the surface of the photosensitive drum 61. Then, when a sheet P passes between the photosensitive drum 61 and the transfer roller 62, the toner image carried on the surface of the photosensitive drum 61 is transferred onto the sheet P.

The fixing unit 7 is disposed above the process cartridge 6 and includes a heat roller (a heating member) 71 and a pressure roller (a backup member) 72.

The heat roller 71 is a member that applies heat to a sheet P, and includes a heat source, e.g., a halogen lamp, which is not shown, inside.

The pressure roller 72 is a member that feeds a sheet P by sandwiching the sheet P with the heat roller 71, and is disposed diagonally upward from the rear side of the heat roller 71.

In the fixing unit 7 structured as described above, the toner transferred onto the sheet P is fixed thermally while the sheet P passes between the heat roller 71 and the pressure roller 72. The sheet P having the toner fixed thermally thereon is conveyed to ejection rollers 8, which are disposed downstream of the fixing unit 7, and ejected from the ejection rollers 8 to an ejection tray 9.

The following will describe a structure around the top cover 22.

Figure 2:
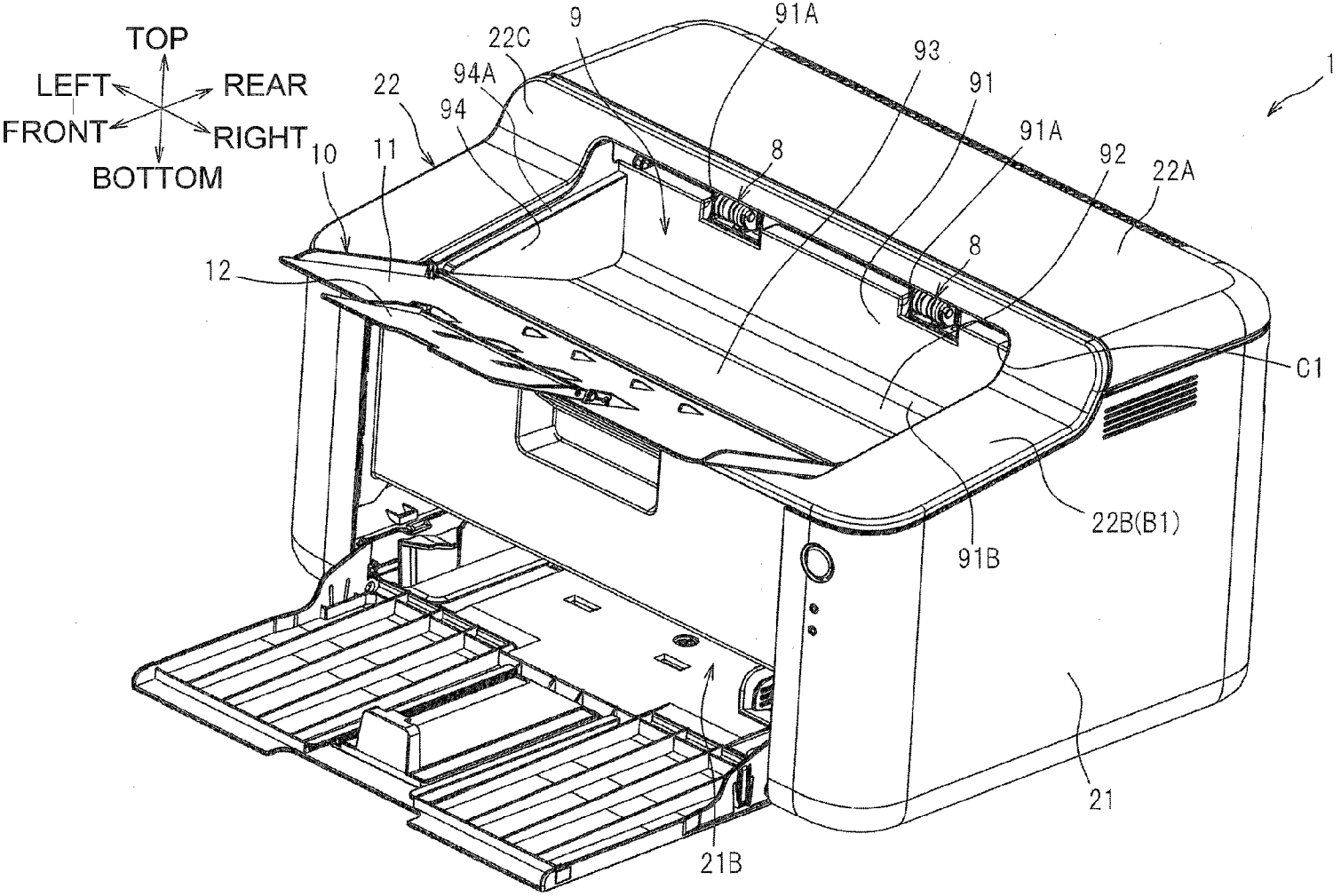
FIG. 2 is a perspective view of the laser printer where a tray cover is in an extended position.

As shown in FIGS. 1 and 2, the top cover 22 includes a first wall portion 22A, a second wall portion 22B, a third wall portion 22C, the ejection tray 9, a tray cover 10, and a part of the ejection rollers 8 (which is a drive roller 81).

The first wall portion 22A is a wall disposed above the ejection rollers 8, and is shaped such that it horizontally extends from a rear end of the casing 21 to a position a little further frontward than the ejection rollers 8. The fixing unit 7 is disposed below the first wall portion 22A (between a rear end portion of the top cover 22 and a vertical wall 91). Specifically, the fixing unit 7 is disposed in a position further rearward than the ejection rollers 8 (or on an upstream side from the ejection rollers 8 in a sheet ejection direction) and lower than the ejection rollers 8. In other words, a nip portion between the heat roller 71 and the pressure roller 72 is located in a position further rearward than and lower than a nip portion between the drive roller 81 and a first driven roller 82 and a nip portion between the drive roller 81 and a second driven roller 83.

In the fixing unit 7, the heat roller 71 is disposed further frontward than the pressure roller 72, and a sheet P ejected from the fixing unit 7 is to be ejected onto the ejection tray 9 with a surface of the sheet P contacting the heat roller 71 facing toward the ejection tray 9. Thus, there is a high possibility that the sheet P to be ejected onto the ejection tray 9 will curl in such a manner as to protrude upward.

The second wall portion 22B is a wall disposed diagonally to the front of and below the first wall portion 22A, and shaped to enclose the perimeter of the ejection tray 9 (specifically, a front end, a left end and a right end thereof). An upper surface B1 of the second wall portion 22B is inclined to the front and downward (toward the downstream side in the sheet ejection direction).

Figure 3:
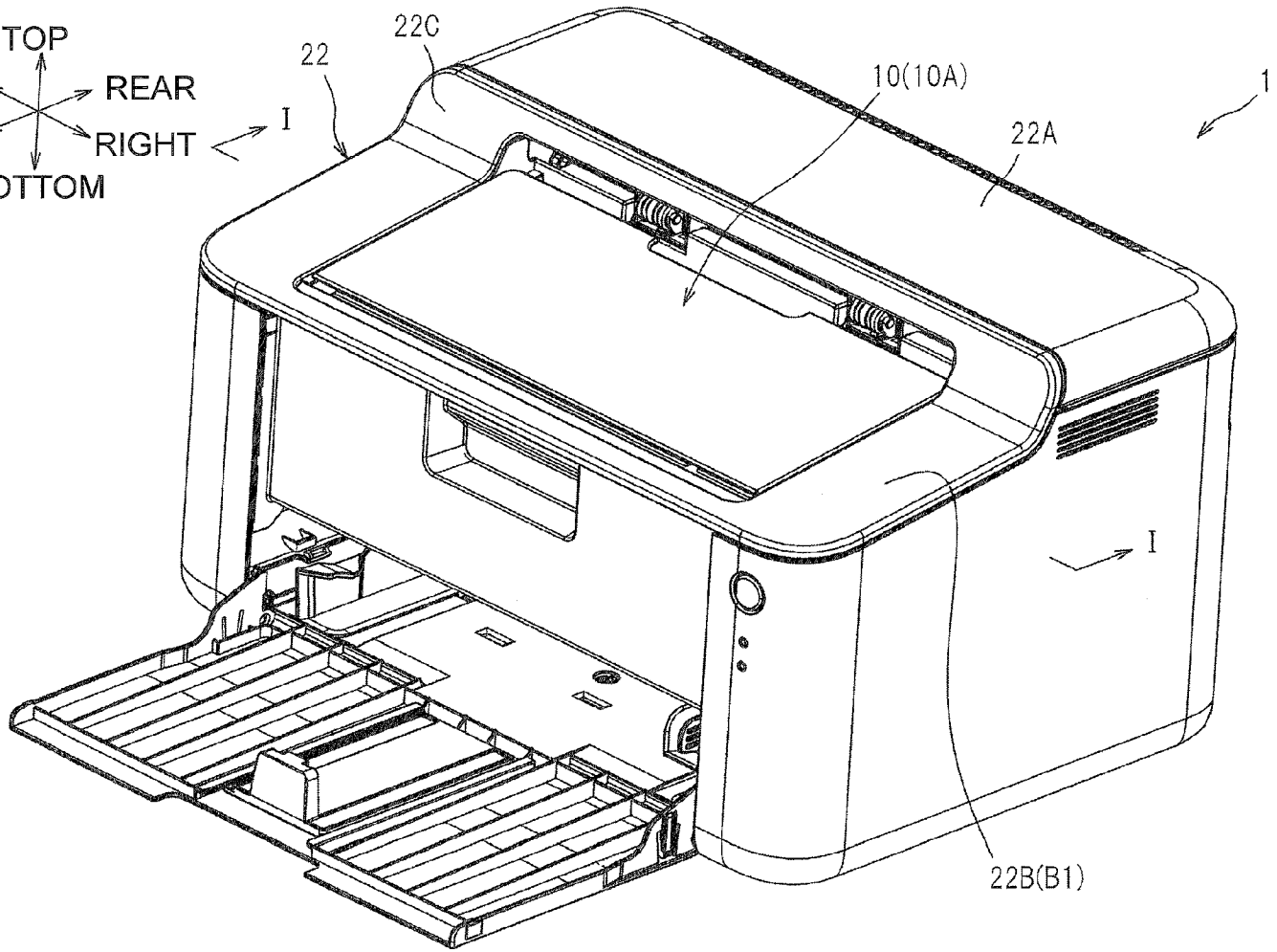
FIG. 3 is a perspective view of the laser printer where the tray cover is in a covering position.
Figure 4:
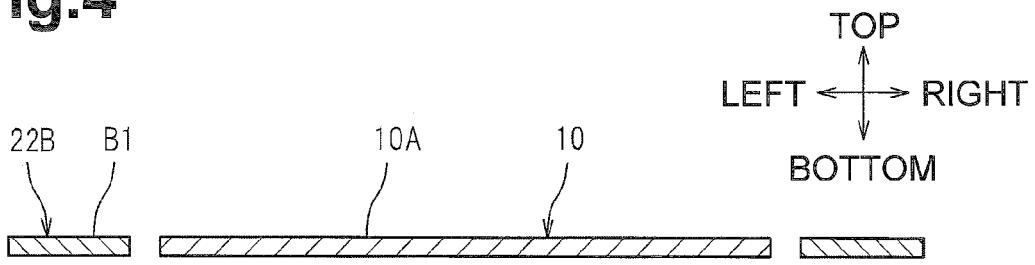
FIG. 4 is a simplified cross-sectional view taken along a line I-I of FIG. 3.

As shown in FIGS. 3 and 4, when the tray cover 10 is located in a covering position, which will be described later, an upper surface 10A of the tray cover 10 is flush with the upper surface B1 of the second wall portion 22B inclined as described above. This structure prevents a difference in level between the tray cover 10 located in the covering position and the second wall portion 22B around the tray cover 10, and thus improves the authentic appearance of the laser printer 1 when the tray cover 10 is located in the covering position.

As shown in FIGS. 1 and 2, the third wall portion 22C is a wall connecting the first wall portion 22A and the second wall portion 22B, and extends in a direction crossing both the first wall portion 22A and the second wall portion 22B. In other words, the top cover 22 is shaped such that the second wall portion 22B in the vicinity of the ejection tray 9 is lowered one step from the first wall portion 22A. Thus, the laser printer 1 can be made compact by one level the second wall portion 22B is lowered from the first wall portion 22A.

The top cover 22 is supported by the casing 21 such that the top cover 22 is pivotable about a rear end portion thereof. In other words, the top cover 22 is supported by the casing 21 such that the top cover 22 is pivotable about a pivot shaft 22D disposed in an area overlapping the first wall portion 22A as viewed from above.

Figure 5:
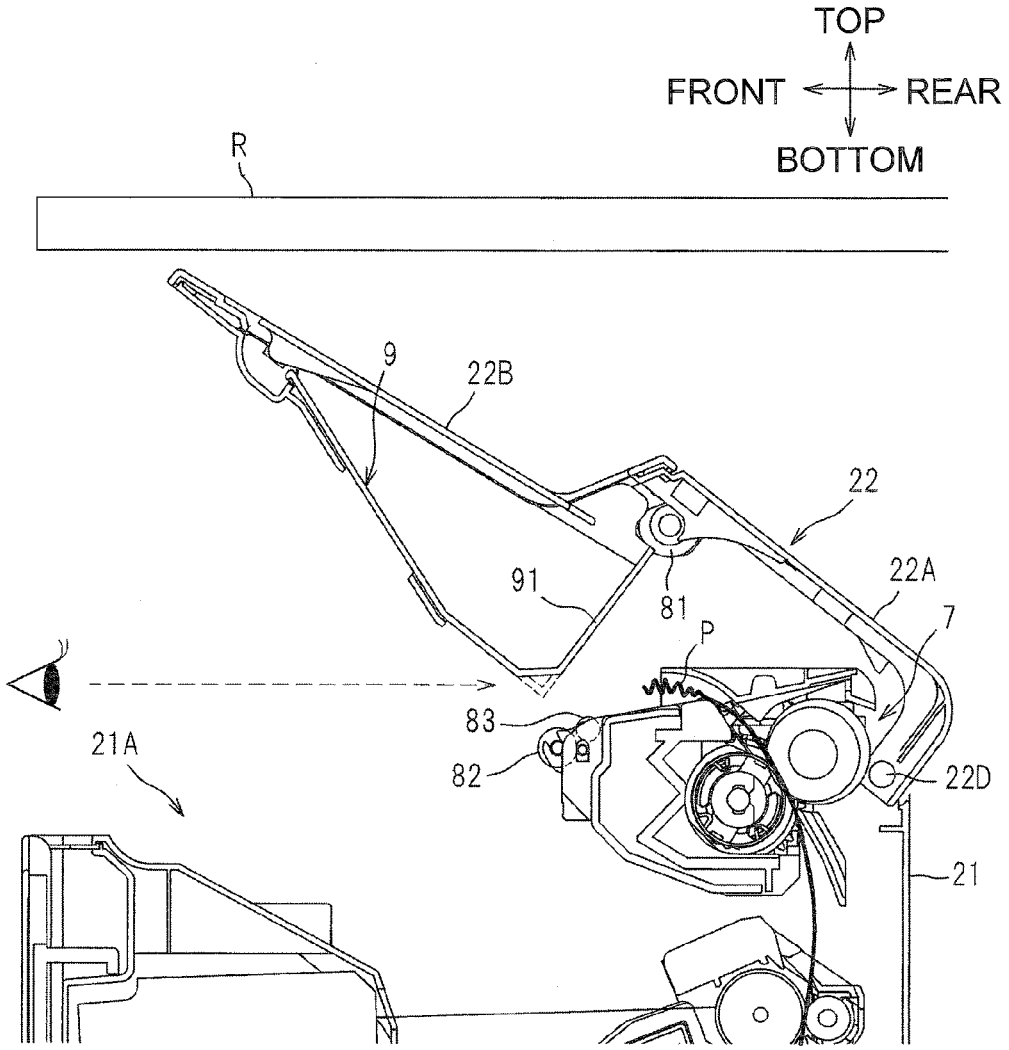
FIG. 5 is a cross sectional view illustrating a user visually checks inside of a main body with a top cover being opened.

As shown in FIG. 5, even when the laser printer 1 is used in a confined storage space under a shelf R, for example, the top cover 22 can be greatly opened by the height equivalent to one step the second wall portion 22B, located on a side opposite to the pivot shaft 22D, is lowered from the first wall portion 22A. Thus, this structure facilitates replacement of the process cartridge 6.

As shown in FIGS. 1 and 2, the ejection tray 9 is shaped such that it is recessed downward from the upper surface of the top cover 22 (minutely, the second wall portion 22B). Specifically, the ejection tray 9 includes a vertical wall 91 extending vertically, a horizontal wall 92 extending horizontally, a sheet support wall 93 inclined relative to a horizontal surface, and a pair of side walls 94 disposed on the left side and right side respectively.

The vertical wall 91 constitutes a rear wall of the ejection tray 9 and is disposed under the ejection rollers 8. Specifically, the vertical wall 91 has two cut portions 91A, which are recessed downward from an upper end of the vertical wall 91 and spaced apart from each other in the left-right direction. Each of the cut portions 91A receives a part of the ejection rollers 8 (minutely, a first driven roller 82).

A lower end portion of the vertical wall 91 contains an inclined portion 91B extending downward diagonally to the front (toward the front end portion of the top cover 22) such that the deepest portion of the ejection tray 9 is located more frontward than the vertical wall 91. With this structure, as shown in FIG. 5, when the user opens the top cover 22 to visually check near an exit of the fixing unit 7 for example, the deepest portion of the ejection tray 9 is less obstructive to the user's line of vision compared with a structure where the deepest portion of the ejection tray 9 is disposed at the lower end of the vertical wall extending vertically (indicated by a broken line). Thus, the structure of the embodiment facilitates visual check near the exit of the fixing unit 7 and clearing of a jammed sheet without the need to open the top cover 22 widely.

As shown in FIG. 1, the horizontal wall 92 extends frontward from a lower end of the inclined portion 91B, is connected to the sheet support wall 93, and thus constitutes the deepest portion of the ejection tray 9. In other words, the horizontal wall 92 is disposed between the sheet support wall 93 and the inclined portion 91B.

The sheet support wall 93 is shaped such that it is inclined diagonally to the front upward from the horizontal wall 92 (or the deepest portion). In other words, the sheet support wall 93 and the inclined portion 91B are shaped such that they are spaced apart from each other as they go upward from the horizontal wall 92, thereby constituting some of walls defining a V-shaped groove.

With this structure, when a trailing end of a sheet P ejected onto the ejection tray 9 gets on the inclined portion 91B, the trailing end of the sheet P is bent by the inclined portion 91B and the sheet support wall 93 such that a bent portion thereof protrudes downward. Thus, even if the sheet P ejected onto the ejection tray 9 is curled so that a curled portion thereof protrudes upward, the curled portion can be corrected to be relatively flattened by correcting the trailing end of the sheet P between the inclined portion 91B and the sheet support wall 93 so that the trailing end thereof protrudes downward.

In the embodiment, as the horizontal wall 92 is disposed between the sheet supply wall 93 and the inclined portion 91B, no narrow corner portion is formed between the sheet supply wall 93 and the inclined portion 91B, compared with a structure where the sheet support wall is directly connected to the inclined portion without the horizontal wall being disposed therebetween. Thus, a curl of a sheet P can be adequately corrected in this embodiment as it will not be excessively corrected in such a narrow corner portion.

The sidewalls 94 are disposed on the left and right sides of the vertical wall 91, the horizontal wall 92 and the sheet support wall 93, such as to connect the left and right ends of those walls 91 to 93.

As shown in FIGS. 1-3, the tray cover 10 is supported by the casing 21 such as to pivot about a pivot shaft (not shown) disposed near the front end of the sheet support wall 93. Specifically, the tray cover 10 is movable, e.g., pivotable, between the covering position where the tray cover 10 covers the upper surface of the ejection tray 9 (or the upper surface of the sheet support wall 93 and one part of the horizontal wall 92 approximate to the sheet support wall 93) and an extended position where the tray cover 10 is extended relative to the front side of the upper surface of the ejection tray 9 (or the upper surface of the sheet support wall 93). The tray cover 10 is supported by an upper end portion 94A of each side wall 94 when located in the covering position.

Another part of the horizontal wall 92 and the inclined portion 91B are covered by the third wall portion 22C and the first wall portion 22A of the top cover 22. Thus, when the tray cover 10 is located in the covering portion, the tray cover 10, the third wall portion 22C and the first wall portion 22A prevent dust from accumulating in the ejection tray 9.

The rear end portion 10B (or an upstream end portion in the sheet ejection direction) of the tray cover 10 located in the covering position is located below the nip portion of the ejection rollers 8 (specifically, a nip portion between the drive roller 81 and the first driven roller 82). With this positional relationship, even when the tray cover 10 is in the covering position, the leading end of the sheet P ejected from the nip portion of the ejection rollers 8 can pass on or over the upper surface of the tray cover 10. This prevents jamming of a sheet P due to contact of the lower surface of the tray cover 10.

When in the covering position, the upper surface of the tray cover 10 is inclined downward to the front side (or to the downstream side in the sheet ejection direction). This inclination prevents dust from entering the rear side of the ejection tray 9 (approximate to the ejection rollers 8) even if the dust is accumulated on the tray cover 10 located in the covering position.

As shown in FIG. 2, the tray cover 10 includes a first extension cover 11 and a second extension cover 12. The first extension cover 11 has a width substantially equal to the ejection tray 9 and is shaped such that, when in the covering position indicated by a chain line in FIG. 1, the first extension cover 11 extends from a position anterior to the front end of the sheet support wall 93 to a position posterior to the front end of the third wall portion 22C.

Specifically, the lower end of the third wall portion 22C has a cut portion C1 recessed upward therefrom (FIG. 2). When the tray cover 10 is in the covering position, the rear end of the first extension cover 11 is disposed more rearward than an edge defining the cut portion C1.

As shown in FIG. 2, the second extension cover 12 is shaped narrower in width than the first extension cover 11 and is pivotally disposed in substantially a central portion of the front end portion of the first extension cover 11 located in the extended position. Specifically, the second extension cover 12 is pivotable between an accommodation position where the second extension cover 12 is folded into the first extension cover 11 in such a manner to face the first extension cover 11 and an open position (FIG. 2) where the second extension cover 12 is located adjacent to the front end of the upper surface of the first extension cover 11 located in the extended position.

Figure 6:
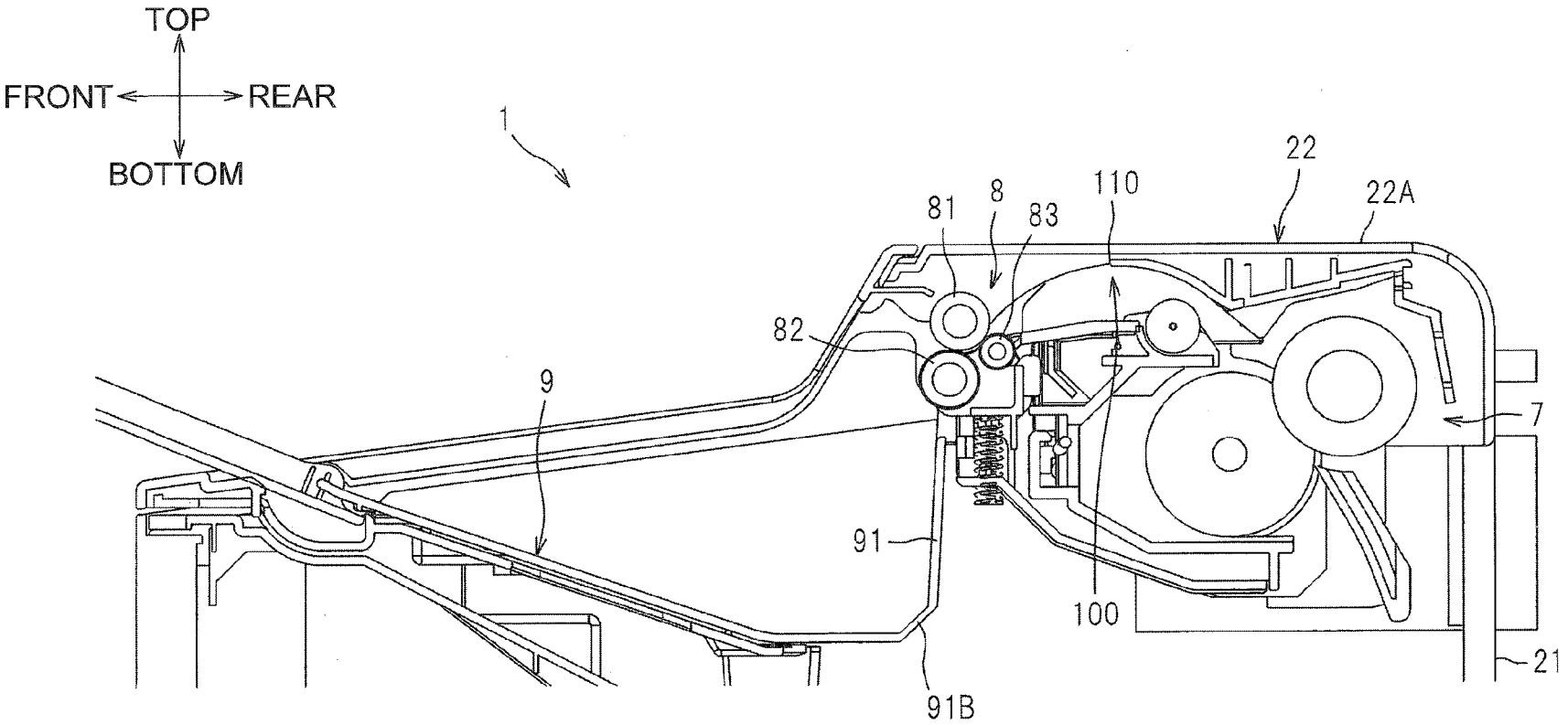
FIG. 6 is an enlarged cross-sectional view illustrating a structure around ejection rollers.

As shown in FIG. 6, the ejection rollers 8 are disposed above the vertical wall 91 of the ejection tray 9 and include the drive roller 81 that receives a drive force and rotates, and a first driven roller 82 and a second driven roller 83 which contact the drive roller 81 and are rotated by the drive roller 81. The first driven roller 82 is disposed in front of the second driven roller 83 (or on a downstream side of the second driven roller 83 in the sheet ejection direction), and has a diameter larger than (different in size from) the second driven roller 83.

With this structure, the first driven roller 82 having a larger diameter improves smoothness of conveyance of a sheet P, while the second driven roller 83 having a smaller diameter contributes to size reduction of the apparatus. In the embodiment, as the diameter of the first driven roller 82, which is disposed on the downstream side in the sheet ejection direction, is made larger, an angle of a sheet P fed from a nip portion between the second driven roller 83 and the drive roller 81 with respect to the first driven roller 82, which is disposed on the downstream side, can be made larger.

Figure 7A:
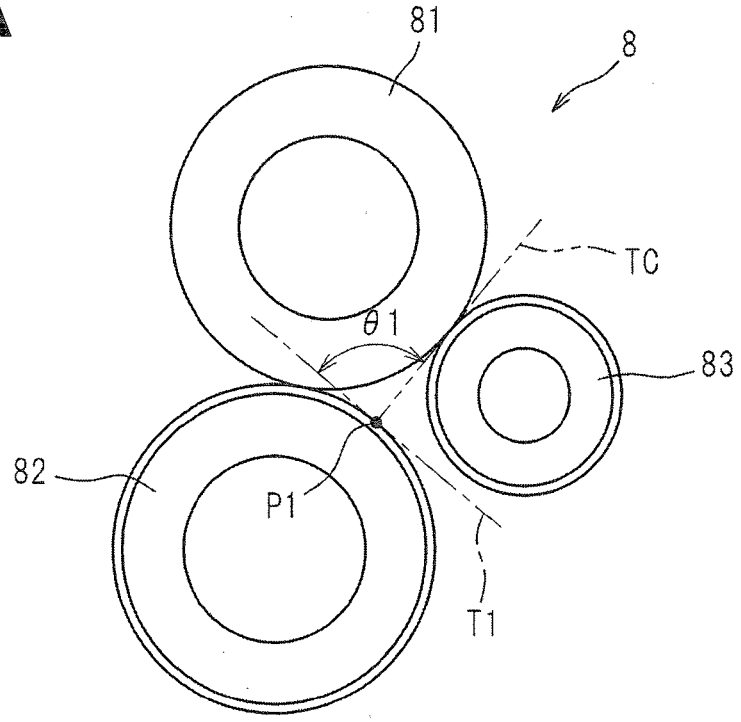
FIG. 7A is an enlarged cross-sectional view illustrating the ejection rollers.
Figure 7B:
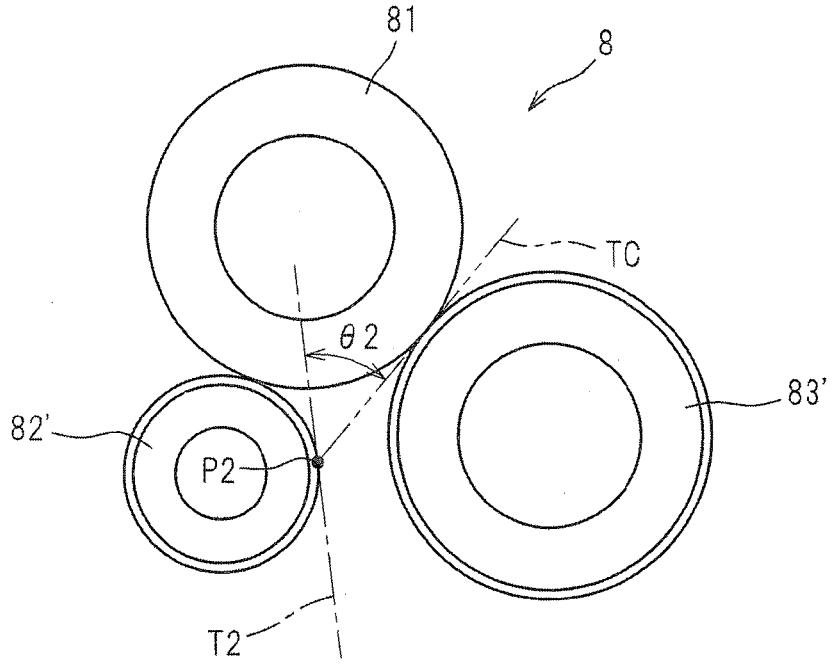
FIG. 7B is an enlarged cross-sectional view illustrating an example of ejection rollers wherein a downstream-side driven roller is smaller in diameter than an upstream-side driven roller.

In other words, as shown in FIG. 7B, if the diameter of a first driven roller 82' disposed on the downstream side in the sheet ejection direction is made smaller than the diameter of a second driven roller 83', an angle θ2 formed by a common tangent TC of the drive roller 81 and the second driven roller 83' and a tangent T2 having a point P2 on which the common tangent TC falls on the first driven roller 82' becomes small. Thus, in this case, there is a high possibility that a sheet P to be fed from between the drive roller 81 and the second driven roller 83' may be jammed at the first driven roller 82' disposed on the downstream side.

However, in the structure of the embodiment, as shown in FIG. 7A, an angle θ1 formed by a common tangent TC of the drive roller 81 and the second driven roller 83 and a tangent T1 having a point P1 on which the common tangent TC falls on the first driven roller 82 is large. Thus, in this embodiment, the sheet P to be fed from between the drive roller 81 and the second driven roller 83 can be prevented from becoming jammed due to collision with the first driven roller 82 disposed on the downstream side.

As shown in FIGS. 5 and 6, the drive roller 81 is rotatably attached to the top cover 22, and the first driven roller 82 and the second driven roller 83 are rotatably attached to the casing 21. With this structure, a sheet jammed among the drive roller 81, the first driven roller 82 and the second driven roller 83 can be easily removed only by opening the top cover 22.

The first driven roller 82 and the second driven roller 83 are arranged along an inclined line with respect to a horizontal surface such that the first driven roller 82 is disposed diagonally to the front below the second driven roller 83. Thus, compared with a structure where two driven rollers are arranged horizontally, an amount of protrusion of the first driven roller 82 from the drive roller 81 toward the downstream side in the sheet ejection direction can be made small.

Although the vertical wall 91 is shifted to the upstream side in the sheet ejection direction compared with the structure where the two driven rollers are arranged horizontally (the structure where the amount of protrusion of the first driven roller 82 from the drive roller 81 toward the downstream side in the sheet ejection direction is large), interference between the vertical wall 91 and the first driven roller 82 when the top cover 22 is opened or closed can be prevented. Thus, compared with the structure where the two driven rollers are arranged horizontally (the structure where the amount of protrusion toward the downstream side is large), the ejection tray 9 can be widened.

A sheet feed path 100 for guiding a sheet P from the fixing unit 7 to the ejection rollers 8 is defined under the first wall portion 22A of the top cover 22. The sheet feed path 100 is shaped in an arc protruding upward.

The nip portions among the ejection rollers 8 (each nip portion between the drive roller 81 and one of the first driven roller 82 and the second driven roller 83) are located diagonally to the front side below a top 110 of the sheet feed path 100. Thus, for example, compared with a sheet feed path for guiding a recording sheet straightly toward ejection rollers disposed at a position diagonally upward of the fixing unit (at a position near the top 110 in FIG. 6), the laser printer 1 can be made compact in size as the ejection rollers 8 of the embodiment can be disposed in positions lower than the top 110 because of the arc shape of the sheet feed path 100.

As the ejection rollers 8 are located more frontward compared with the structure where the ejection rollers 8 are disposed near the top 110, the lower end of the inclined portion 91B of the vertical wall 91 disposed below the ejection rollers 8 (or the deepest portion in the ejection tray 9) is also located more frontward. Thus, when the top cover 22 is in the open position, the structure in the vicinity of the outlet of the fixing unit 7 can be easily viewed.

The embodiment shows, but is not limited to that, when the tray cover 10 is in the covering position, the upper surface 10A of the tray cover 10 is inclined downward to the front. For example, the upper surface of the tray cover may be disposed horizontally when in the covering position. This case also prevents dust on the tray cover located in the covering position from falling to a corner close to the ejection rollers of the ejection tray.

The embodiment shows, but is not limited to, the openable top cover 22 as an example of an upper wall of the main body. The top cover 22 may be a stationary wall.

The embodiment shows, but is not limited to, that the ejection rollers 8 include one drive roller 81 and two driven rollers 82 and 83. For example, the ejection roller may include one drive roller and one driven roller.

The sheets P, as an example of recording sheets, may include thick paper, postcards, thin paper, and transparencies.

The above embodiment shows, but is not limited to, the laser printer 1. The disclosure may be applicable to other image forming apparatuses, such as a copier and a multifunction apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an ejection tray having an upper surface constituting a bottom portion of the ejection tray, the ejection tray including a side wall extending upward from the upper surface and a support portion disposed at an upper end of the side wall;

a plurality of ejection rollers having a nip portion where the plurality of ejection rollers nip a recording sheet therebetween, the plurality of ejection rollers being configured to eject the recording sheet onto the upper surface of the ejection tray; and a tray cover having a first surface and a second surface opposite to the first surface, the tray cover being configured to move between an extended position where the tray cover is extended relative to the ejection tray and the first surface faces upward to receive the recording sheet ejected from the nip portion, and a covering position where the tray cover is supported by the support portion of the ejection tray to cover the upper surface of the ejection tray and the second surface faces upward, the tray cover having a first end and a second end in a sheet ejection direction in which the recording sheet is ejected, wherein, when the tray cover is in the extended position, the first end of the tray cover corresponds to a downstream end in the sheet ejection direction and the second end of the tray cover corresponds to an upstream end in the sheet ejection direction, and wherein, when the tray cover is in the covering position, the first end of the tray cover corresponds to the upstream end in the sheet ejection direction and the second end of the tray cover corresponds to the downstream end in the sheet ejection direction, wherein, when the tray cover is in the covering position where the tray cover is supported by the support portion disposed at the upper end of the side wall extending upward from the upper surface of the ejection tray, the tray cover is spaced apart from the upper surface of the ejection tray and the first end of the tray cover is disposed in a position closer to the nip portion of the plurality of ejection rollers than the upper surface of the ejection tray and lower than the nip portion such that a leading end of the recording sheet ejected from the nip portion of the plurality of ejection rollers passes on or over the second surface of the tray cover.

2. The image forming apparatus according to claim 1, wherein, when the tray cover is in the covering position, the second surface of the tray cover is inclined downward to a downstream side in the sheet ejection direction.

3. The image forming apparatus according to claim 1, further comprising a main body having an upper wall from which the ejection tray is recessed downwardly, wherein, when the tray cover is in the covering position, the second surface of the tray cover is flush with an upper surface of a wall portion of the upper wall of the main body disposed around the ejection tray.

4. The image forming apparatus of claim 3, wherein the upper surface of the ejection tray is disposed partially at a first angle relative to the upper wall and the second surface of the tray cover, in the covering position, is disposed at a second angle relative to the upper wall, the first angle being different from the second angle.

5. The image forming apparatus according to claim 1, further comprising a main body having an upper wall from which the ejection tray is recessed downwardly, wherein the upper wall includes a first wall portion disposed above the plurality of ejection rollers, a second wall portion disposed below the first wall portion and around the ejection tray, and a third wall portion extending in a direction crossing the first wall portion and the second wall portion and connecting the first wall portion and the second wall portion.

6. The image forming apparatus according to claim 5, wherein the main body includes a casing having, in an upper portion, an opening through which a process cartridge is attached or removed, wherein the upper wall includes a top cover for opening and closing the opening, and is supported by the casing such that the upper wall pivots about an axis located in an area overlapping the first wall portion as viewed from above.

7. The image forming apparatus according to claim 5, further comprising a fixing unit disposed under the first wall portion and configured to thermally fix a developer image on the recording sheet, wherein the first wall portion defines thereunder a sheet feed path for guiding the recording sheet from the fixing unit toward the plurality of ejection rollers, wherein the sheet feed path is shaped in an arc protruding upward, and wherein the nip portion of the plurality of ejection rollers is disposed below a top of the sheet feed path.

8. The image forming apparatus according to claim 1, wherein, when the tray cover is in the covering position, the first end of the tray cover is disposed facing one of the plurality of ejection rollers.

9. The image forming apparatus according to claim 1, wherein, when the tray cover is in the covering position, the tray cover covers an entirety of the upper surface of the ejection tray.

10. The image forming apparatus according to claim 1, wherein a downstream end of the upper surface of the ejection tray, in the sheet ejection direction, is disposed higher than any other portion of the upper surface of the ejection tray.

11. The image forming apparatus according to claim 10, wherein the tray cover pivots between extended position and the covering position about a pivot axis located at the downstream end of the upper surface of the ejection tray.

12. The image forming apparatus according to claim 1, wherein, when the tray cover moves from the extended position to the covering position, the second end of the tray cover moves away from a downstream end of the ejection tray, the downstream end of the ejection tray being covered by the tray cover when the tray cover is in the covering position.

* * * * *